United States Patent [19]

Mayer

[11] 4,040,042

[45] Aug. 2, 1977

[54] EXHAUST APPARATUS AND MONITORING CIRCUIT THEREFOR

[76] Inventor: Horst Mayer, Wagenbergstrasse 33, Neheim-Huesten 2, Germany, 5760

[21] Appl. No.: 704,947

[22] Filed: July 13, 1976

[51] Int. Cl.[2] ..... G08B 21/00

[52] U.S. Cl. ..... 340/239 F; 55/274; 55/DIG. 34; 340/236; 126/299 D

[58] Field of Search ..... 340/236, 239 F; 55/274, 55/DIG. 34, 213; 98/115 K

[56] References Cited

U.S. PATENT DOCUMENTS

| | | | |
|---|---|---|---|
| 2,074,152 | 3/1937 | Mueller | 55/274 X |
| 2,172,399 | 9/1939 | Mueller | 55/274 X |
| 2,523,967 | 9/1950 | Nystul | 340/239 F |
| 2,700,362 | 1/1955 | Calling | 340/239 F |
| 2,707,879 | 5/1955 | Dwyer | 55/274 X |
| 3,201,772 | 8/1965 | Ladusaw | 340/239 F |
| 3,505,791 | 4/1970 | Breslin | 55/274 |
| 3,552,098 | 1/1971 | Cochran | 55/274 |
| 3,738,088 | 6/1973 | Colosimo | 55/274 X |
| 3,811,250 | 5/1974 | Fowler, Jr. | 55/274 |
| 3,812,370 | 5/1974 | LaViolette | 55/274 X |

*Primary Examiner*—John W. Caldwell
*Assistant Examiner*—Daniel Myer
*Attorney, Agent, or Firm*—W. G. Fasse; W. W. Roberts

[57] ABSTRACT

The present exhaust apparatus has a housing with a tiltable front wall and a tiltable bottom wall. The front wall carries the fan unit proper with its drive motor and filter and the tiltable bottom wall may be provided with a light. In order to monitor the operation of the fan in response to the contamination of a filter, there is provided a membrane switch which responds to a predetermined reduced pressure in a space between the filter and the exhaust fan, as well as a further circuit means which respond to the power consumption of the fan motor. The membrane switch and the further circuit means may be arranged in parallel or in series with an alarm device such as a light or a buzzer.

14 Claims, 5 Drawing Figures

EXHAUST APPARATUS AND MONITORING CIRCUIT THEREFOR

BACKGROUND OF THE INVENTION

The present invention relates to an exhaust apparatus and to monitoring means for such an exhaust apparatus. The monitoring means activate an alarm device, such as a light and/or buzzer any time when the filter of the exhaust apparatus requires cleaning or replacing.

Prior art monitoring devices for the operation of exhaust fans with filter means have the disadvantage that the increasing contamination of the filter means and thus the decreasing efficiency of the filter action cannot be ascertained with the desired precision and certainty. As a result, it is possible that the fan motor may be exposed to damaging speed increases due to load reduction and the suction efficiency and odor removal are reduced. For these reasons motor burn-outs in conventional exhaust fans cooperating with a filter are not uncommon.

In view of the above, it has been suggested heretofore to monitor the degree of contamination of a filter arrangement in an exhaust mechanism with the aid of a poppet or disk valve arranged to connect the atmosphere with the space between the filter device and the exhaust fan proper. Such a valve responds to the pressure difference in front of and behind the filter device and actuates a suitable signalling device when the valve opens in response to a predetermined, adjustable reference pressure to thereby indicate that the filter requires cleaning or replacement. However, such a pressure differential responsive valve is itself rather sensitive to contaminations. Therefore, a continuous maintenance is necessary for monitoring the valve. As a result, such valves are not very effective for the intended purpose.

OBJECTS OF THE INVENTION

In view of the above it is the aim of the invention to achieve the following objects singly or in combination:

to overcome the drawbacks of the prior art, more specifically, to provide an exhaust fan and filter device with a monitoring mechanism or circuitry which is continuously sensitive to the efficiency of operation of the exhaust mechanism, while not requiring any monitoring for itself;

to simultaneously monitor the suction efficiency of the exhaust mechanism as well as the power input to the fan motor for activating alarm means;

to monitor the reduced pressure between a filter and the fan proper by means of a membrane switch for activating an alarm device; and to construct the exhaust fan housing in such a manner that the operating elements of the exhaust mechanism may be tilted into an inoperative position and into an operative position and that a bottom closure wall of the exhaust housing may also be tilted from an operative to an inoperative position.

SUMMARY OF THE INVENTION

According to the invention there is provided an exhaust apparatus having a housing with a membrane switch therein located in such a position that it can monitor the reduced pressure in the space between the filter means and the fan proper relative to the atmosphere and that an electronic sensing device is arranged for cooperation with the exhaust fan motor to monitor the power input of the motor. The membrane switch and said sensing device responsive to the power input of the motor cooperate in the energization of alarm means, such as a light and/or buzzer to indicate the need for cleaning or replacing the filter means.

The arrangement of the invention has the advantage that a reduced pressure is formed in the space between the filter and the fan which depends on the degree of contamination of the filter. Such reduced pressure is monitored by the membrane switch which may be adjustable to respond or rather close a circuit as a function of a predetermined reduced pressure.

The invention takes into account the fact that a contaminated filter results in an air passage through the filter which for aerodynamic reasons, causes a decrease in the load on the suction blower which is undesirable, because it increases the speed of the electric blower motor. To avoid such increased motor speeds the invention monitors the power consumption of the blower motor by means of a power consumption sensing device arranged in series with the blower motor to also provide a warning signal in cooperation with or in addition to the warning signal provided by the membrane switch. The power consumption sensing circuit means may include a thyristor circuit which as such is conventional. The indication may be optically and/or acoustically to signify that the filter must be cleaned or replaced. Due to the redundancy provided by the invention, the two monitoring devices, namely, the membrane switch and the power consumption sensing device monitor each other, thereby making it possible to keep the exhaust apparatus at peak function and efficiency while simultaneously avoiding a burn-out of the blower motor.

BRIEF FIGURE DESCRIPTION

In order that the invention may be clearly understood, it will now be described, by way of example, with reference to the accompanying drawings, wherein.

Figure 1:
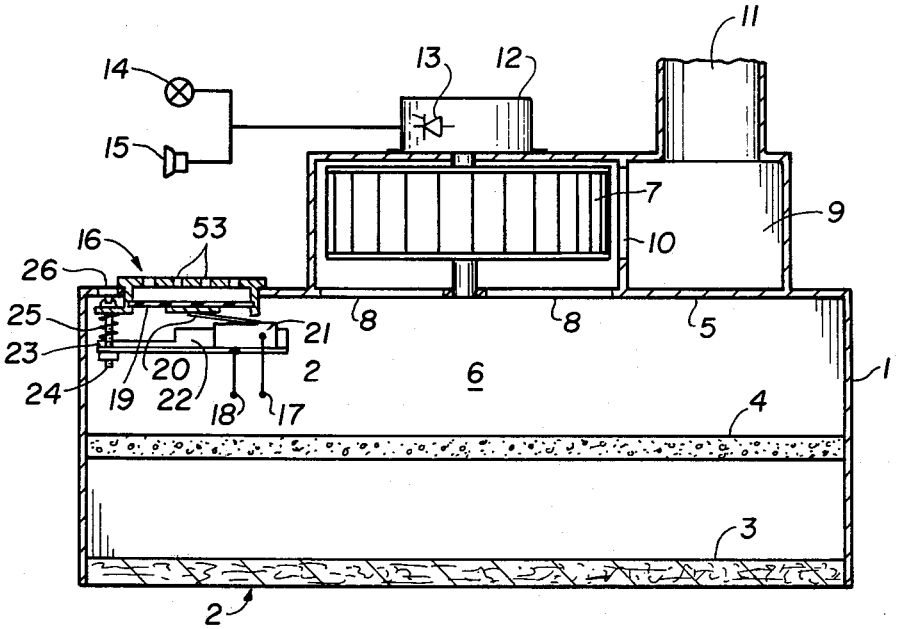
FIG. 1 is a sectional view through the housing of an exhaust apparatus showing the membrane switch and in simplified form the power consumption monitoring device.

DETAILED DESCRIPTION OF PREFERRED EXAMPLE EMBODIMENTS:

FIG. 1 illustrates a sectional view through an exhaust apparatus according to the invention. The apparatus comprises an arrangement operating as an air return fan, which may, for example, be used above the range in a kitchen without the need for a flue or stack leading to the outside. The apparatus comprises a housing 1 with an inlet port 2 which is covered by a filter 3 for removing particles suspended in the air. A further filter 4 is also arranged in the housing. The filter 4 may, for example, comprise substances for the removal of odors. One substance suitable for this pupose is charcoal particles, also known as absorbent carbon. Between the rear wall 5 of the housing 1 and the filter 4 there is a space 6 through which the filtered air flows toward the fan 7 through exit ports 8. An exhaust channel 9 communicates with the housing 1 and thus with the fan 7 through a port 10. The air may then return through an exit port 11 into the kitchen or wherever the fan is being used.

The fan 7 is driven by a motor 12 which in turn is controlled by electronic circuit means 13 symbolically shown in FIG. 1. The electronic circuit means will be described in more detail below.

The electronic monitoring circuit may operate alarm devices such as a light 14 and/or a buzzer 15. In addition to the monitoring provided by the electronic circuit 13 a redundancy is provided according to the invention by means of a membrane switch 16 having terminals 17 and 18. The membrane switch 16 operates as a so called snap action or quick break switch in response to a certain reduced pressure developed in the space 6. Such switches 16 are known as such in the art. The membrane switch 16 further comprises a rubber membrane 19 acting through a tilting lever 20 onto the snap switch 21 proper. The snap switch 21 is secured to a bar 22, the outer end 23 of which is adjustable by means of a screw 24 working against a pressure spring 25. The adjustment of the switch 21 may thus be accomplished through an aperture 26 in the housing 1, whereby the response characteristic of the snap switch may be varied so that the switch responds to different reduced pressures in the space 6.

Figure 3:
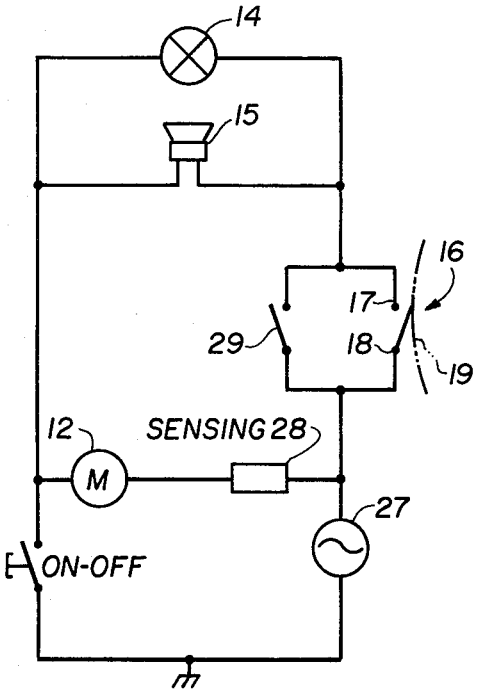
FIG. 3 is a circuit diagram of one embodiment of the monitoring circuit according to the invention.

In view of the foregoing, it will be appreciated that the operation of the membrane switch 16 will depend on the degree of contamination of the filters 3 and 4. In other words, when the filters 3 and 4 are contaminated to such an extent that the membrane 19 responds to the suction effect it will energize a light 14 and/or a buzzer 15, for example, in a circuit as shown in FIG. 3 from a source of power 27. The circuit may also comprise an "on-off" switch shown in FIG. 3, but not in FIG. 1. The motor 12 is connected to the source of power 27 through power consumption sensing means 28 forming part of the electronic monitoring circuit 13, one embodiment of which is shown in FIG. 3 in a greatly simplified manner by a contact 29 connected in parallel to the membrane switch 16 to provide the desired redundancy. Thus, the arrangement of FIG. 3 provides a warning signal even when only one of the switching means 16, 29 closes the respective circuit.

The sensing means 28 to be described in more detail below, monitor the power consumption of the motor 12 from the power supply 27. Thus, if the filters 3 and 4 are contaminated to such a degree that the air resistance to the fan 7 is reduced, the power consumption of the motor 12 will also be reduced, which may result in an undesirable increase in speed, such that a motor burnout could occur. The monitoring circuit may comprise a relay responsive to the power comsumption for closing the switch 29, which thus would operate the alarm means 14, 15 in the same manner as the membrane switch 16.

Figure 2:
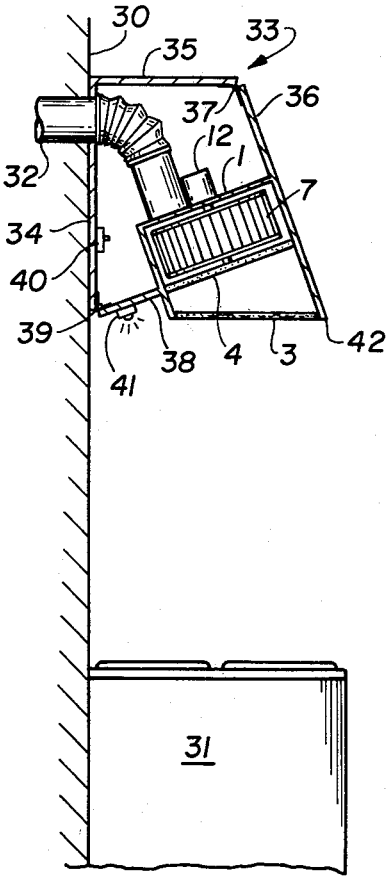
FIG. 2 is a sectional view through a device as illustrated in FIG. 1 secured to a vertical wall, whereby the section extends perpendicularly to the wall.

FIG. 2 illustrates a view partially in section through a practical application of the present exhaust apparatus secured to a wall 30 above a kitchen range 31. An exhaust pipe 32 leads either directly to the outside or through a flue not shown. The same reference numbers are employed in FIG. 2 as in FIG. 1 and FIG. 3. However, the housing 1 in FIG. 2 is arranged inside a hood 33 and the air is exhausted rather than returned into the kitchen.

Figure 4:
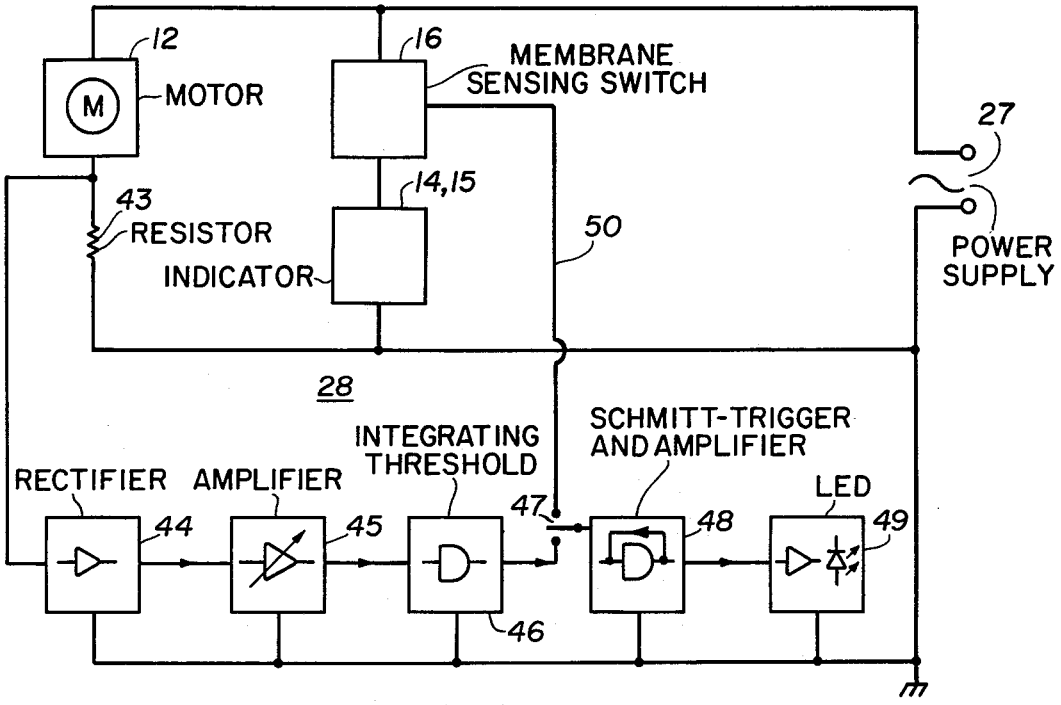
FIG. 4 is a further block circuit diagram of a power consumption monitoring circuit according to the invention.
Figure 5:
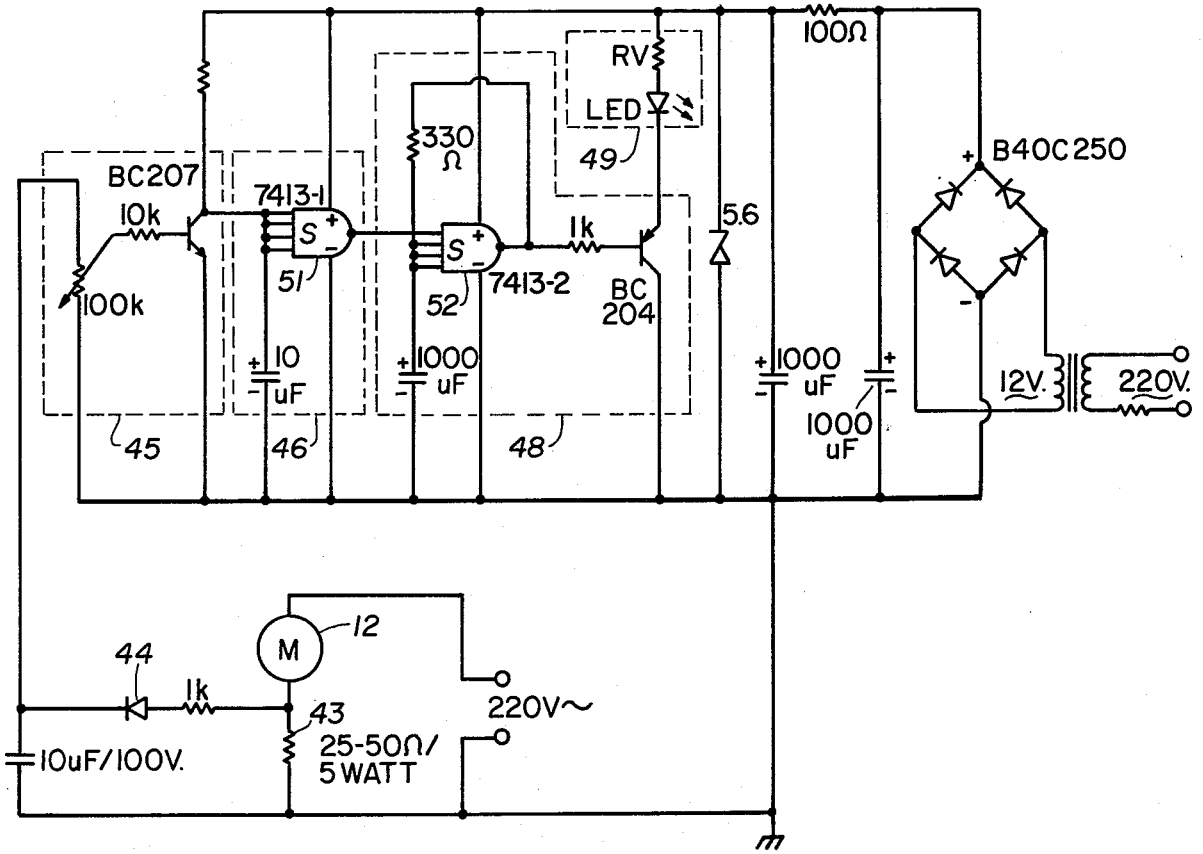
FIG. 5 shows the power consumption monitoring circuit in greater detail.

The hood 33 comprises a back wall 34 secured to the kitchen wall 30. A top wall 35 extends, for example, horizontally away from the back wall 34. A front wall 36 is hinged by means of hinges 37 to the free end of the top wall 35. A bottom wall 38 is hinged by hinge means 39 to the lower end of the back wall 34. The bottom wall 38 may thus be pivoted against a door switch 40 which may activate a light 41 when the exhaust fan is in its operating, shown position. When the bottom wall 38 is pivoted against the back wall 34, the light 41 will be switched off and the front wall 36 with the housing 1 secured thereto will also be tilted against the wall in an inoperative position. The filter means 3 and 4 are arranged in the same manner as shown in FIG. 1. The entire unit may simply be brought into its operational position by pulling at the lower edge 42 in a direction to move the front wall 36 away from the back wall 34. If desired, the light 41 may operate as the warning signal 14 and the door switch 40 may operate as the on-off switch. In any event, the bottom wall 38 will close the space inside the hood when the latter is in the operating forward position and the bottom wall 38 will be tilted upwardly when the hood is in the retracted inoperative position. Referring to FIG. 4 there is shown in a simplified block diagram the sensing means 4 providing the redundancy in the monitoring function as described above. The membrane switch 16 is connected in series with the indicating means 14 and 15 and to the power supply 27, in parrallel to the motor 12 just as in FIG. 3. The sensing means 28 comprises a resistor 43 connected in series with the motor 12 for sensing the power consumption of the motor 12. The voltage drop across the resistor 43 is supplied to a rectifier 44 and the rectified voltage at the output of the rectifier is amplified in an amplifier 45, the output of which is passes through an integrating threshold circuit 46. Incidentally, the amplifier 45 may be adjustable in its amplification. The threshold circuit 46 makes sure that the warning signal will be energized only in response to a certian value representing a given contaminatin of the filters. In other words, if the filters are only slightly contaminated, the warning will not be given. Thus, at the output of the threshold circuit 46 there will appear either a certain voltage or none. The output of the threshold circuit 46 is connected to a selector switch 47 forming the input to a Schmitttrigger and amplifier circuit 48. The output of the Schmitttrigger circuit in turn is connected to a warning signal indicator such as a light emitting diode 49. FIG. 5 illustrates one detailed embodiment of what is shown in FIG. 4, whereby the same reference numbers are employed, and wherein thyristors 51 and 52 may, for example, be used.

Incidentally, a conductor 50 may provide an operative connection between the membrane sensing switch means 16 and the Schmitttrigger amplifier 48, whereby the latter may be responsive to a pressure reduction in the space 6 and/or to the power consumption of the motor 12.

With regard to the membrane switch 16 it should be mentioned, that upon reduction of the pressure in the space 6, the membrane 19 will bend inwardly due to the larger atmospheric pressure outside the housing 1 and which is effective through the apertures 53 (FIG. 1). Such inward bending of the membrane 19 will actuate the switch. The adjustment of the screw 24 and spring 25 makes is possible to make the switch responsive to very fine pressure differences.

In view of the foregoing, it will be appreciated that the electronic circuit arrangement may be responsive either to the reduced power consumption as monitored by the voltage drop across the resistor 43 or it may be responsive to the membrane switch as symbolically indicated by the conductor 50.

Although the invention has been described with reference to specific example embodiments, it is to be understood that it is intended to cover all modifications and equivalents within the scope of the appended claims.

What is claimed is:

1. Exhaust apparatus comprising a housing, fan means operatively arranged in said housing, filter means opertively arranged in said housing to provide a space between the filter means and the fan means, motor means operatively connected to drive said fan means, an aperture in said housing to connect said space to the atmosphere, membrane switch means located in said aperture and responsive to predetermined pressure changes in said space, power consumption sensing means opertively connected to said fan drive motor means, alarm means, and electric circuit means operatively interconnecting said alarm means, said membrane switch means, and said consumption sensing means with a source of power to activate said alarm means in response to predetermined operating conditions of said exhaust apparatus.

2. The apparatus according to claim 1, wherein said membrane switch means comprise an elastic membrane closing said aperture in said housing, tiltable lever means responsive to the movement of said elastic membrane, and contact means responsive to said tiltable lever means.

3. The apparatus according to claim 2, further comprising support means for said contact means and adjustment means operatively connected to said support means for adjusting the response characteristic of said contact means.

4. The apparatus according to claim 1, wherein said power consumption sensing means comprise thyristor means and relay switch means which close said circuit means to activate said alarm means in response to a change in the power consumption of said motor means from a predetermined level.

5. The apparatus according to claim 1, wherein said power consumption sensing means comprise relay means and respective contact means, said membrane switch means and said contact means being connected in parallel to each other, said parallel connection being connected in series with said alarm means.

6. The apparatus according to claim 1, wherein said membrane switch means is also operatively connected to said power consumption sensing means to render the latter effective.

7. The apparatus according to claim 1, wherein said housing comprises a back wall, a horizontally extending top wall with a free edge and a front wall extending substantially vertically and having an upper edge, said top wall being secured to said back wall, hinge means securing said upper edge of said front wall to said free edge of the top wall, means securing said fan means, said filter means, said motor means, said membrane switch means and said further switch means as well as said power consumption sensing means to said front wall whereby the just listed elements form a unit which is shiftable toward and away from said back wall.

8. The apparatus according to claim 7, wherein said unit is in its operating position with said front wall tilted away from said back wall and in its inoperative position with said front wall tilted toward said back wall.

9. The apparatus according to claim 7, wherein said housing further comprises bottom wall means, further hinge means hinging said bottom wall means to the lower end of said back wall, whereby said bottom wall means are tiltable toward and away from said back wall, said bottom wall closing said housing in its operative position tilted away from said back wall.

10. The apparatus according to claim 9, wherein said alarm means are secured to said bottom wall.

11. The apparatus according to claim 9, further comprising lighting means secured to said bottom wall means, and contact means operatively arranged to energize said lighting means when said bottom wall means are tilted away from said back wall.

12. The apparatus according to claim 1, wherein said power consumption sensing means comprise voltage drop resistor means connected in series with said motor means, and display means connected to said resistor means for indicating the power consumption of said motor means.

13. The apparatus according to claim 12, wherein said power consumption sensing means comprise electronic circuit means including an amplifier, an integrating threshold circuit and a Schmitt-trigger circuit connected in that order and wherein said display means comprise light emitting diode means connected to the output of said Schmitt-trigger circuit.

14. The apparatus according to claim 13, further comprising means selectively connecting said Schmitt-trigger circuit to said membrane switch means for energizing said display means.

* * * * *